US008604999B2

(12) United States Patent
Abumrad et al.

(10) Patent No.: US 8,604,999 B2
(45) Date of Patent: Dec. 10, 2013

(54) STRAND MOUNTABLE ANTENNA ENCLOSURE FOR WIRELESS COMMUNICATION ACCESS SYSTEM

(75) Inventors: James Abumrad, Belmont, CA (US); Roger Haas, Scotts Valley, CA (US)

(73) Assignee: Public Wireless, Inc., San Jose, CA (US)

( * ) Notice: Subject to any disclaimer, the term of this patent is extended or adjusted under 35 U.S.C. 154(b) by 345 days.

(21) Appl. No.: 13/164,491

(22) Filed: Jun. 20, 2011

(65) Prior Publication Data

US 2011/0309996 A1 Dec. 22, 2011

Related U.S. Application Data

(60) Provisional application No. 61/356,972, filed on Jun. 21, 2010.

(51) Int. Cl.
*H01Q 1/42* (2006.01)

(52) U.S. Cl.
USPC ..... 343/872; 343/874; 343/878

(58) Field of Classification Search
USPC ..... 343/872, 874, 878
See application file for complete search history.

(56) References Cited

U.S. PATENT DOCUMENTS

| | | | | |
|---|---|---|---|---|
| 3,400,402 | A * | 9/1968 | Gallagher et al. | 343/723 |
| 8,023,826 | B2 * | 9/2011 | Fasshauer et al. | 398/116 |
| 2008/0136598 | A1 * | 6/2008 | Chen et al. | 340/10.1 |

* cited by examiner

*Primary Examiner* — Dieu H Duong
(74) *Attorney, Agent, or Firm* — Procopio, Cory, Hargreaves & Savitch LLP

(57) ABSTRACT

An antenna enclosure is designed to be suspended from a line such as a messenger strand which extends in a first direction between a pair of utility poles, in a similar manner to other aerial strand mounted communication system components. At least one antenna element is mounted in the enclosure. The antenna enclosure in one example is elongated in the first direction and tapers inwardly in a vertical direction between the upper and lower ends of the enclosure. Two spaced connecting brackets mounted on the upper end of the enclosure are configured for connection to spaced positions on a line to suspend the enclosure from the line.

29 Claims, 12 Drawing Sheets

STRAND MOUNTABLE ANTENNA ENCLOSURE FOR WIRELESS COMMUNICATION ACCESS SYSTEM

RELATED APPLICATION

The present application claims the benefit of co-pending U.S. provisional pat. App. Ser. No. 61/356,972 filed Jun. 21, 2010, the contents of which are incorporated herein by reference in their entirety.

BACKGROUND

1. Field of the Invention

The present invention relates generally to the field of communication systems and more specifically to wireless communication access systems and strand mountable antennas for such systems.

2. Related Art

Operators of wireless or cellular communication networks typically use large towers and antennas to cover most of a desired coverage area for the communication system. Building and deployment of new towers and antennas can give rise to aesthetic objections from the community. Thus, it can be difficult for operators to secure necessary sites for locating base stations, repeaters, and associated antennas which make up wireless communication access systems.

It is known to use existing aerial strand infrastructure, e.g. utility wires or messenger strands extending between utility poles, for mounting wireless communication access equipment such as modems and base stations.

SUMMARY

Embodiments described herein provide for a strand or wire mountable antenna system comprising an outer antenna enclosure or housing with antenna elements and associated circuitry mounted in the enclosure.

According to one embodiment, an antenna enclosure is designed to be suspended from an overhead wire or line such as a messenger strand or cable extending between a pair of utility poles. The antenna enclosure has a relatively small form factor that does not resemble the large antennas traditionally used to provide wireless network coverage in wireless communication access systems. Thus, it may be possible to deploy such enclosures from messenger strands or overhead sites without the aesthetic objections often raised with respect to new towers.

In one embodiment, the antenna enclosure is a hollow shell made of a material which is nonconductive and transparent to radio frequency (RF) radiation, the shell having an upper end and a lower end and defining an interior cavity. At least one antenna element is mounted in the cavity, and at least one connecting bracket is coupled to the upper end of the shell and configured for connecting the antenna enclosure to a messenger cable extending in a first direction between two utility poles such that the hollow shell is suspended from the messenger cable. At least one cable connector extends through the shell wall and is configured for connection to external and internal cables for signal communication to and from the antenna element. Additional cable connection may be provided as needed, depending on the number of antenna elements.

The shell in one embodiment is elongated in the first direction and tapers inwardly in a vertical direction between the upper and lower end of the shell. In this embodiment, first and second spaced connecting brackets are coupled to the upper end of the shell and configured for connecting the antenna enclosure to spaced locations on a messenger cable so that the shell is suspended in a generally vertical direction from the cable in low wind or no wind conditions. The shell may have a shape or form factor similar or at least no larger than that of other strand or cable mounted components so that it does not stand out from other enclosures or components suspended from the cable, and may be designed to blend in aesthetically with other cable mounted components.

In one embodiment, the shell has an upper end wall, opposite side walls and opposite end walls, and the side walls are of inwardly tapering shape towards the lower end of the shell, and define a generally V-shaped vertical cross-section through the shell in a direction transverse to the first direction, with the lower end of the enclosure forming the apex of the V-shape. The tapering, u-shaped vertical cross-section provides an strand mounted antenna arrangement in an enclosure which is compact and unobtrusive, and which blends in aesthetically and unobtrusively with other cable components.

In one embodiment, the antenna enclosure comprises a base having an open top and a cover secured over the open top of the base. A ground plane may be secured in the enclosure over the open top of the base with the antenna element or elements secured to the ground plane and suspended in the base beneath the ground plane. There may be one, two, or three or more antenna elements in the enclosure. Other components or antenna circuitry may be mounted in the space between the ground plane and inner surface of the cover. One or more coaxial cable connectors may be provided on the enclosure, for example at either end of the enclosure, and connected to corresponding coaxial cables inside the enclosure used to communicate with the antenna elements and associated circuitry. The cable connectors may be connected to external cables for wireless communication with one or more other components of a wireless communication access system, such as base station components.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a strand mountable antenna enclosure which blends in aesthetically with other strand mounted components and equipment.

After reading this description it will become apparent to one skilled in the art how to implement the invention in various alternative embodiments and alternative applications. However, although various embodiments of the present invention will be described herein, it is understood that these embodiments are presented by way of example only, and not limitation. As such, this detailed description of various alternative embodiments should not be construed to limit the scope or breadth of the present invention.

The systems and methods disclosed herein can be applied to various communication systems including various wireless technologies. For example, the systems and methods disclosed herein can be used with Cellular 2G, 3G, 4G (including Long Term Evolution ("LTE"), LTE Advanced, WiMax), and other wireless technologies. Although the phrases and terms used herein to describe specific embodiments can be applied to a particular technology or standard, the systems and methods described herein are not limited to the these specific standards.

Although the phrases and terms used to describe specific embodiments may apply to a particular technology or standard, the methods described remain applicable across all technologies.

Figure 1:
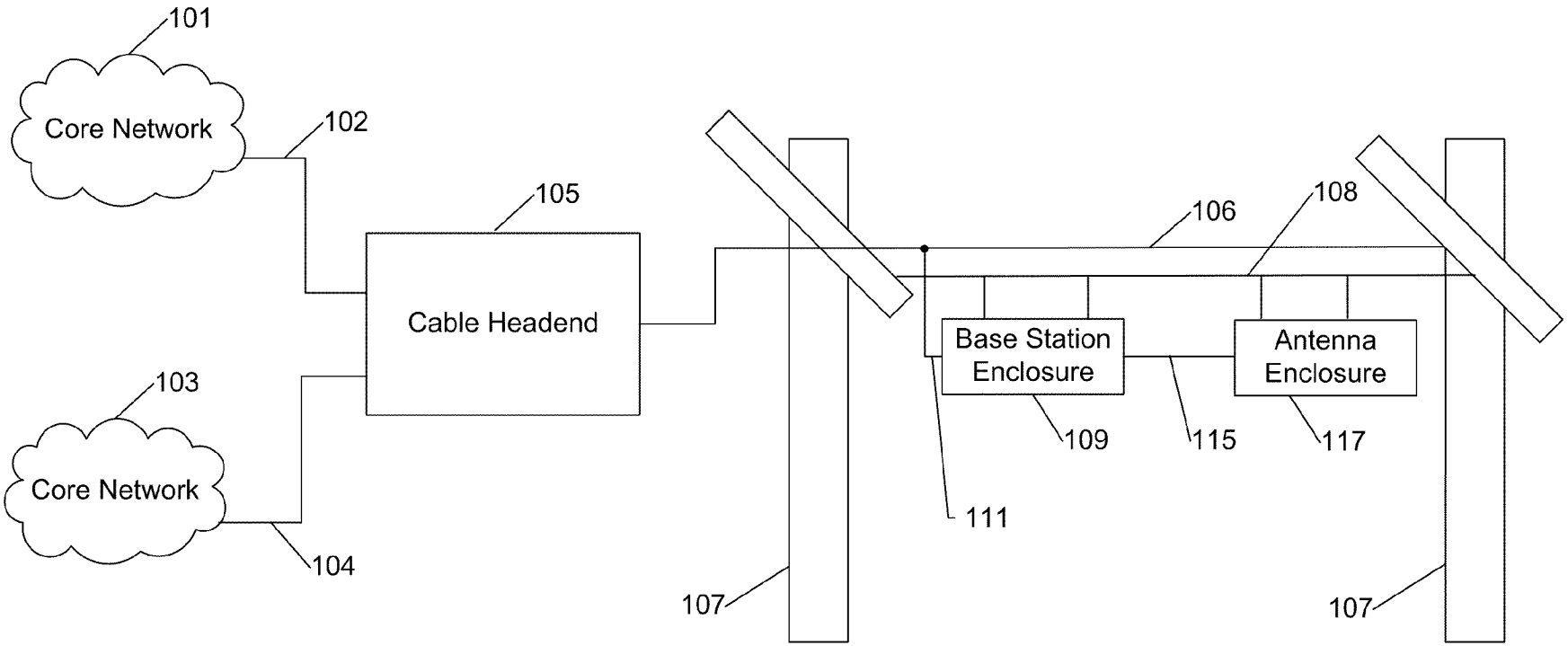
FIG. 1 is a block diagram of a wireless communication network incorporating an embodiment of a wireless communication access system having a strand mounted base station and antenna enclosure.

FIG. 1 is a block diagram of a wireless communication network having a wireless communication access system including an antenna enclosure 117 according to one embodiment. One or more core networks 101 and 103 are connected to a cable headend 105 via respective communication lines 102 and 104. The cable headend 105 is connected to a cable 106. In one embodiment, the cable 106 is a hybrid fiber cable. The cable 106 is supported by a plurality of utility poles 107. The cable may also be supported by a line or wire 108. For example, the cable 106 may be periodically coupled to the wire 108 by a lashing or other connection. The cable 106 is connected to a base station enclosure 109 via a connection 111. The base station enclosure 109 is mechanically supported by the wire or line 108. In one embodiment, the line 108 is a messenger strand or cable, but in other embodiments it may any single or multiple strand line extending between utility poles which is of sufficient strength to support the enclosure. The base station is connected to an antenna enclosure 117 via a connection such as a coaxial cable 115. The antenna enclosure 117 is also mechanically supported by the wire 108. The wire 108 is supported by the utility poles 107.

In operation, in one example, one or more antenna elements are mounted inside the antenna enclosure 117 and operate to receive and transmit radio frequency (RF) signals. When receiving, the RF signals are transferred from the antenna enclosure 117 to the base station enclosure 109. Circuitry inside the base station enclosure 109 processes the signals. In one embodiment, the base station enclosure 109 operates in a manner similar to a traditional base station. This can include for example, processing the signal received via the antenna enclosure 117 and transferring the received signal or some portion of the data contained therein to a core network 101 via the cable 106, the cable headend 105, and the communication line 102. The cable headend 105 comprises circuitry for processing signals received from the base station enclosure 109 and transmitting the received signals to the core networks 101 and 103. Thus, the base station enclosure 109 is able to use the cable plant as a backhaul network. In the case of transmission, data may be transmitted from the core networks 101 and 103 to the base station enclosure 109 through the communication lines 102 and 104, cable headend 105, and cable 106 to the base station enclosure 109. Circuitry inside the base station module 109 may then process the data for transmission and drive the antenna elements in the antenna enclosure 117 to transmit the data. In one embodiment, the antenna enclosure 117 contains multiple antenna elements or may contain one or more antenna elements which are configured to receive signals in multiple spectrum bands used by different network operators, as described in more detail below. The base station enclosure 109 can comprise base station circuitry from a plurality of network providers. Data received via the antenna enclosure 117 may be transmitted to core networks 101 and 103 corresponding to each respective network provider. Advantageously, the present embodiments allow network providers to deploy unobtrusive antennas and base stations on existing cables or wires between utility poles in order to fill coverage holes or to provide supplemental coverage in areas of high demand. Further, as the cable 106, wire 108 and utility poles 107, are already present, the base station and antenna enclosures 109 and 117 may be deployed cheaply and quickly without requiring the deployment of additional infrastructure, and are not as noticeable to members of the public as stand-alone cellular towers and antennas. Additional details and examples are described in greater detail below.

Figure 2A:
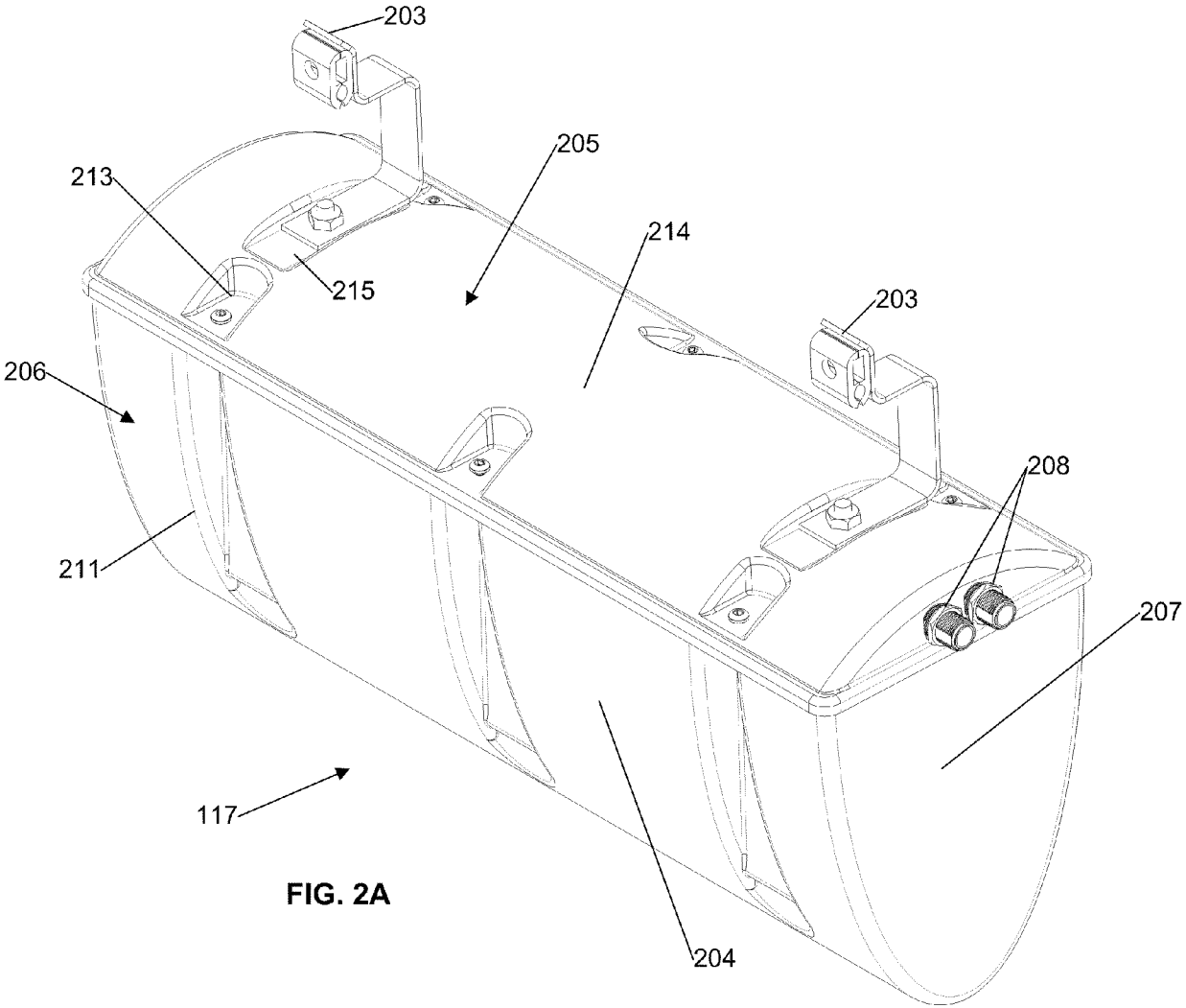
FIG. 2A is a perspective view of an antenna enclosure according to one embodiment.

FIGS. 2A to 10 illustrate an antenna enclosure 117 according to one embodiment. The antenna enclosure 117 basically comprises a hollow shell comprising a base 206 and a cover 205 secured over the open top of the base 206, and supporting members or connecting brackets 203 coupled to cover 205 for securing the antenna enclosure to a wire or line 108 extending in a first direction between two utility poles. In one embodiment, the wire 108 may be a messenger strand or cable. The shell in one embodiment is elongated in the first direction, with a length greater than the transverse width of the shell, and tapers inwardly in a vertical direction between the upper and lower end of the shell, as illustrated in FIGS. 2A and 3A. The supporting members 203 can be attached to a wire 108 for mechanical support, as illustrated in FIGS. 3A and 3B. The cover 205 and base 207 of the shell are made of a material that is nonconductive and transparent to RF radiation (e.g., providing very little to no interference to the RF frequencies used in the desired application). For example, the cover 205 and base 207 may be made of rubber or plastic. One or more antenna elements are mounted inside the shell. One embodiment of a shell including multiple antenna elements is described in more detail below in connection with FIGS. 10 and 11.

Figure 9:
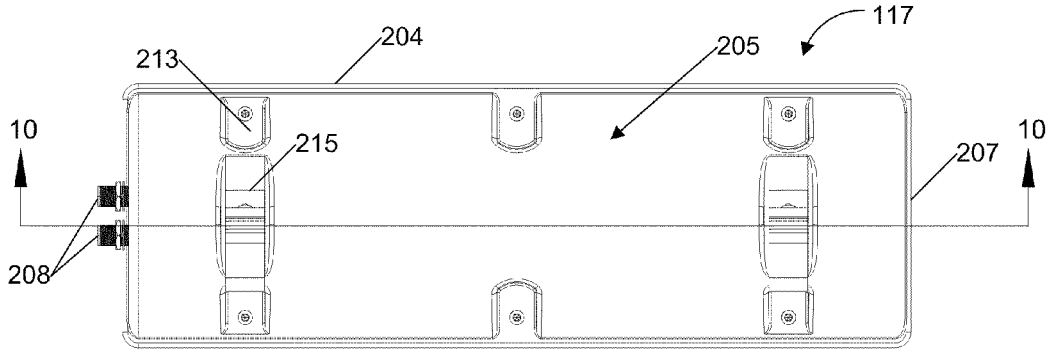
FIG. 9 is a top plan view of the assembled antenna enclosure of FIGS. 2A and 3 to 8.
Figure 10:
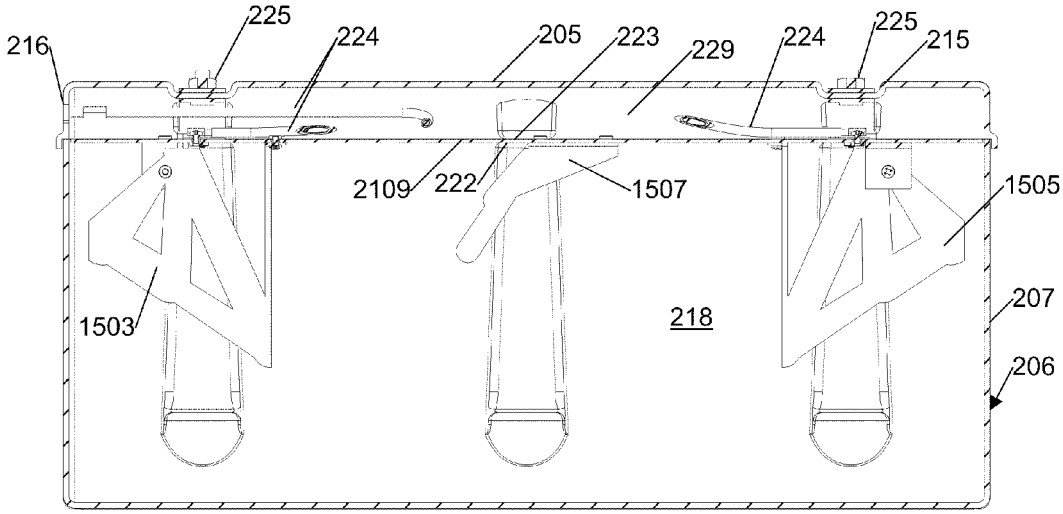
FIG. 10 is a cross-sectional view on the lines 10-10 of FIG. 9 illustrating the ground plane and antenna elements inside the enclosure according to one embodiment.

Coaxial cable connectors 208 extend through openings 216 in one or both end walls of the cover 205, as best illustrated in FIGS. 2A, 9 and 10, for connection to external coaxial cables and corresponding coaxial cables inside the antenna enclosure used to communicate with one or more antenna elements housed within the antenna enclosure 117. One, two or more radiating antenna elements may be mounted inside enclosure 117. In one embodiment, the antenna enclosure 117 comprises two radiating antenna elements. In this embodiment, two internal coaxial cables carry the signals to the connectors 208. External coaxial cables then carry the signals to another device such as the base station enclosure 109 of FIG. 1. In this manner, the antenna elements within the antenna enclosure 117 may be driven by the base station enclosure 109.

The supporting members or connecting brackets 203 in one embodiment are made of a conductive material such as metal. Accordingly, the wire connected to the brackets 203 for mechanical support may act as an additional ground for the antenna enclosure 117 via the connectors. A ground is also provided by the external coaxial cables connected to the connectors 208, and a ground plane 2109 inside the enclosure (see FIGS. 10 and 11). The various grounds may provide advantageous protection from events such as lightning strikes.

Figure 3A:
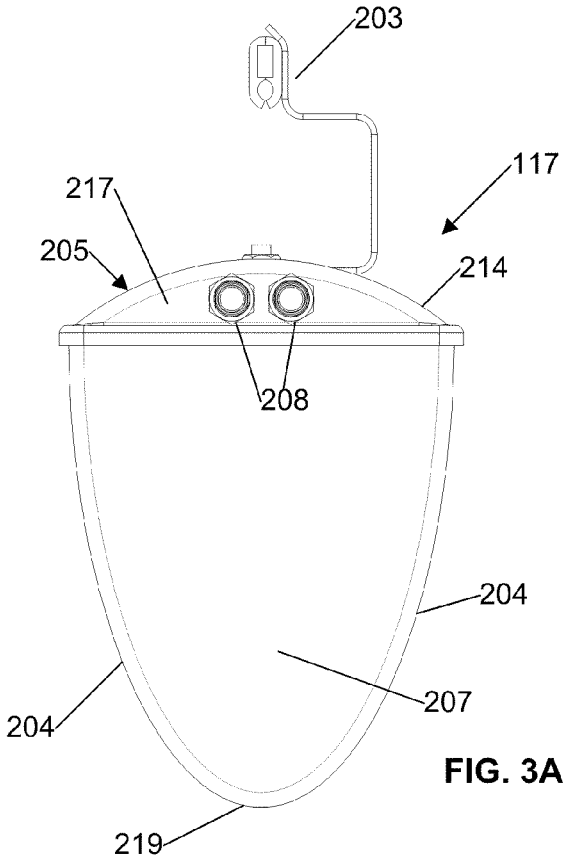
FIG. 3A is an end elevation view of the antenna enclosure of FIG. 2A suspended from a strand or wire.
Figure 3B:
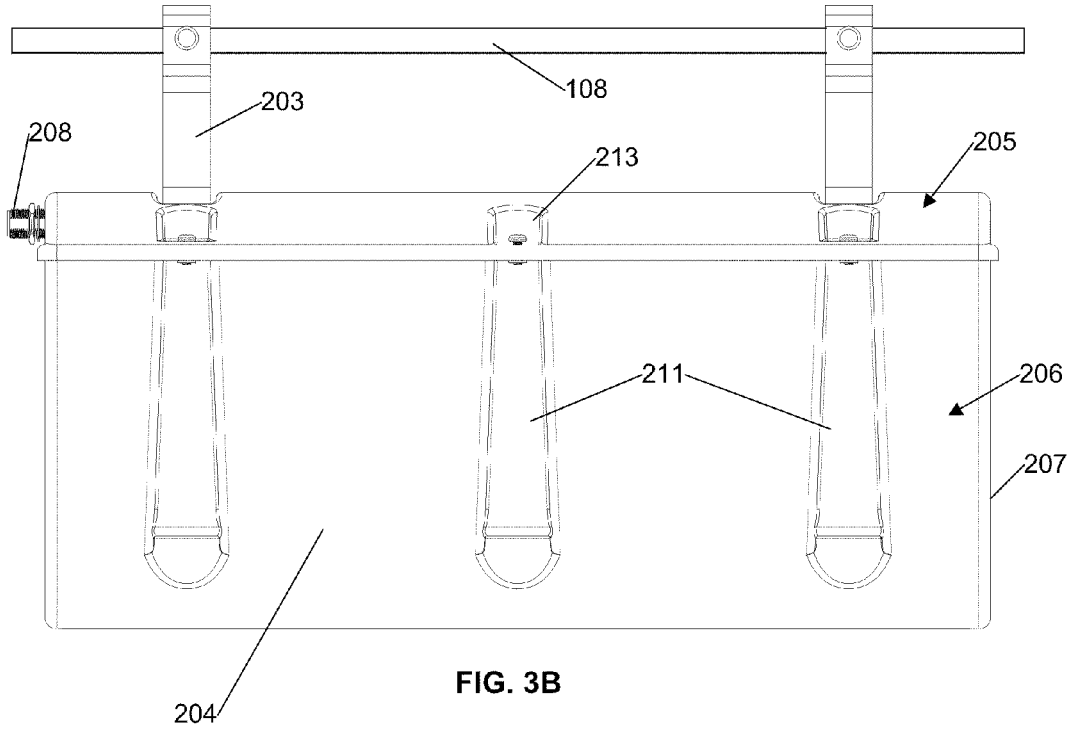
FIG. 3B is a side elevation view of the antenna enclosure of FIGS. 2A and 3A.
Figure 4:
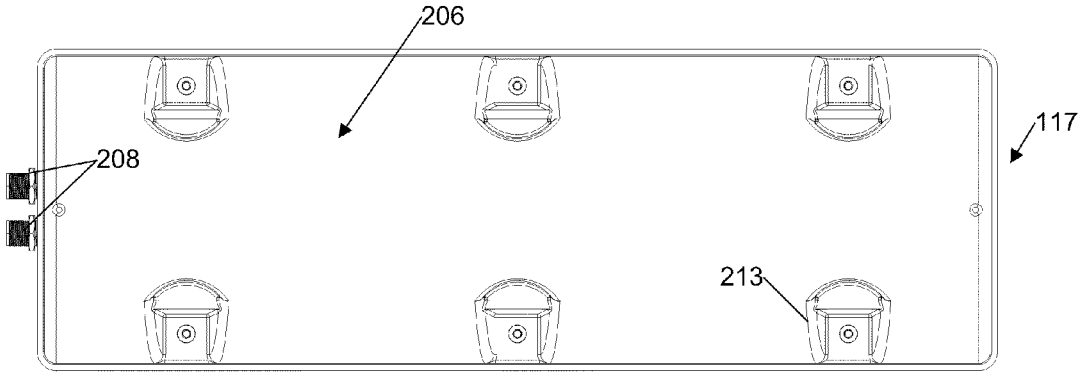
FIG. 4 is a bottom plan view of the antenna enclosure of FIGS. 2A to 3B.
Figure 5:
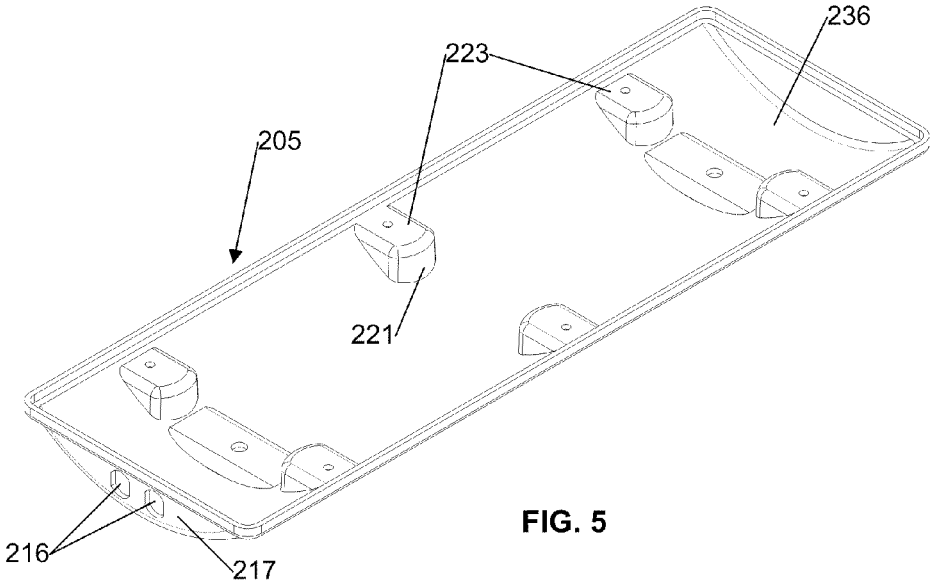
FIG. 5 is a bottom perspective view of the cover of the antenna enclosure of FIGS. 2A to 4.
Figure 6:
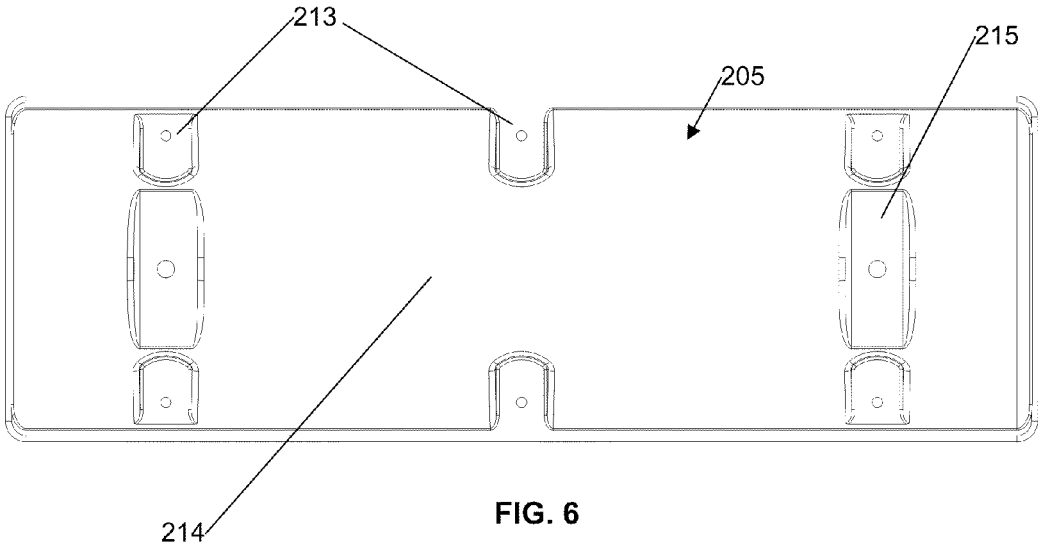
FIG. 6 is a top plan view of the cover of FIG. 5.
Figure 7:
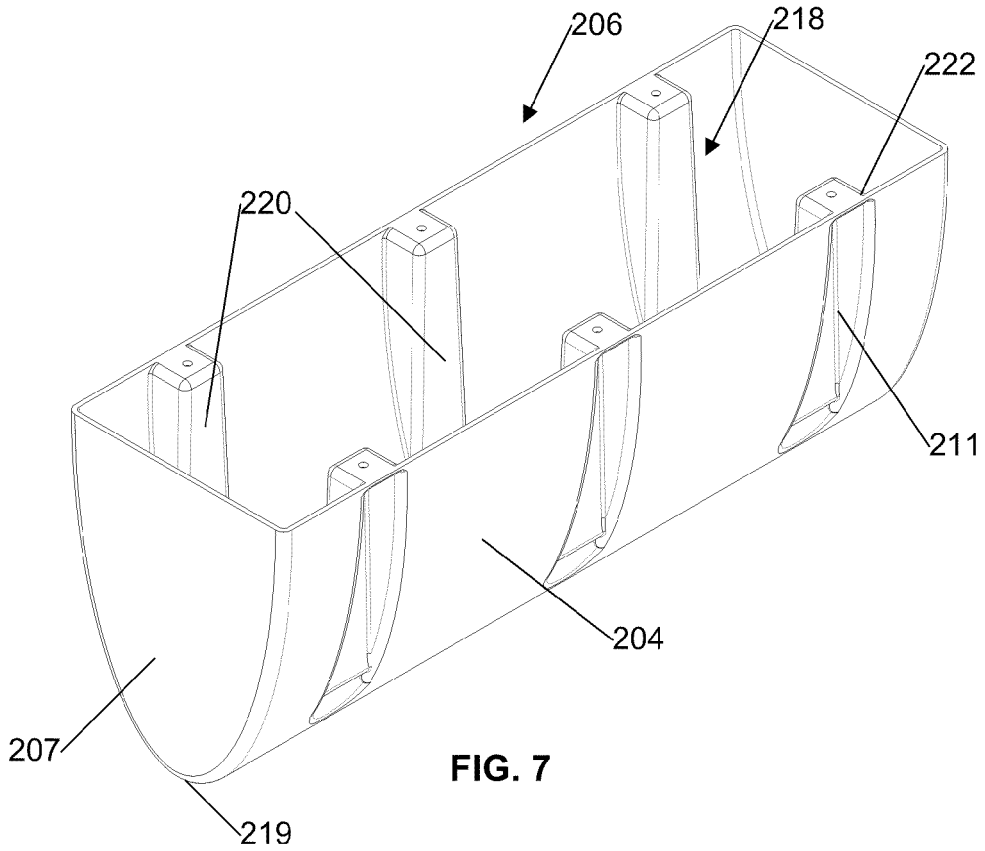
FIG. 7 is a top perspective view of the base or shell of the antenna enclosure of FIGS. 2A to 4 with the cover removed.
Figure 8:
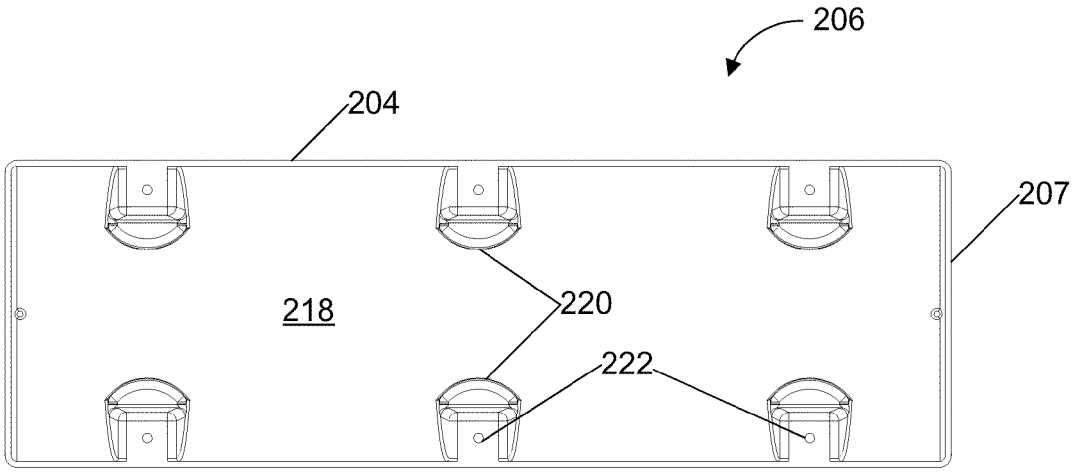
FIG. 8 is a top plan view of the base of FIG. 7.

As illustrated in FIGS. 7 and 8, base 206 of the enclosure has a generally rectangular upper open end, with opposite side walls 204 curving downwardly and inwardly from the open upper end to a generally rounded apex 219 at the lower end of base 206, and opposite flat end walls 207. This forms a generally V-shaped or tapering U-shaped aerodynamic cross section, as seen in FIG. 3A. The cover 205 is illustrated in more detail in FIGS. 5 and 6 and is configured to fit over the rectangular upper open end of the base. Cover 205 has a convex upper surface extending between opposite side edges, and flat opposite end walls 217 (see FIGS. 2A and 5). The inner surface 236 of the cover is concave, as seen in FIG. 5.

Base 206 has a hollow interior chamber with three pairs of oppositely directed ribs 220 on the inside of the side walls 204, with corresponding indents or channels 211 on the outer faces of side walls 204, as best illustrated in FIG. 7. The ribs are of tapering height from their upper to their lower ends, which blend in with the curved inner surface of the respective side wall, and the corresponding outer channels 211 are of corresponding tapered height between the upper and lower ends, as best illustrated in FIG. 7. Ribs 220 have upper flat ends 222 providing supports for ground plane 2109, as illustrated in FIG. 10. The cover 205 is also formed with indented grooves or channels 213 on its outer, convex surface 214. Channels 213 are aligned with the respective channels 211 in the outer side walls when the parts are assembled as in FIG. 2A. As best illustrated in FIG. 5, the indented channels 213 on the outer surface of the cover form corresponding projections 221 on the inner, concave surface 236 of the cover. Projections 221 have flat end faces 223 which provide mounting surfaces for the ground plane, as described in more detail below.

Additional mounting recesses or indents 215 are located on the cover between the channels 213 closest to the opposite ends of the cover, as illustrated in FIG. 6. Indents 215 act as seats for mounting the connecting brackets 203 so that they protrude upwardly away from the cover, as illustrated in FIG. 2A. The ends of the respective brackets 203 are secured in the seats by suitable fasteners 225, as illustrated in FIG. 10. By providing two spaced connecting brackets on the cover of the elongate antenna enclosure 117, twisting of the enclosure relative to the wire 108 is prevented.

Enclosure 117 is of a compact and tapering shape so that it blends in aesthetically with other cable components while disguising the enclosed antenna elements. The shape is more aerodynamic and aesthetically pleasing than a rectangular box-shape enclosure. The enclosure tends to hang vertically downwards when suspended from an overhead wire, due to its shape, and is not particularly noticeable. The enclosure is likely to be seen to observers as an unobtrusive part of the overall aerial infrastructure with which they are already familiar, rather than as a new, unsightly, and bulky piece of equipment.

Figure 2B:
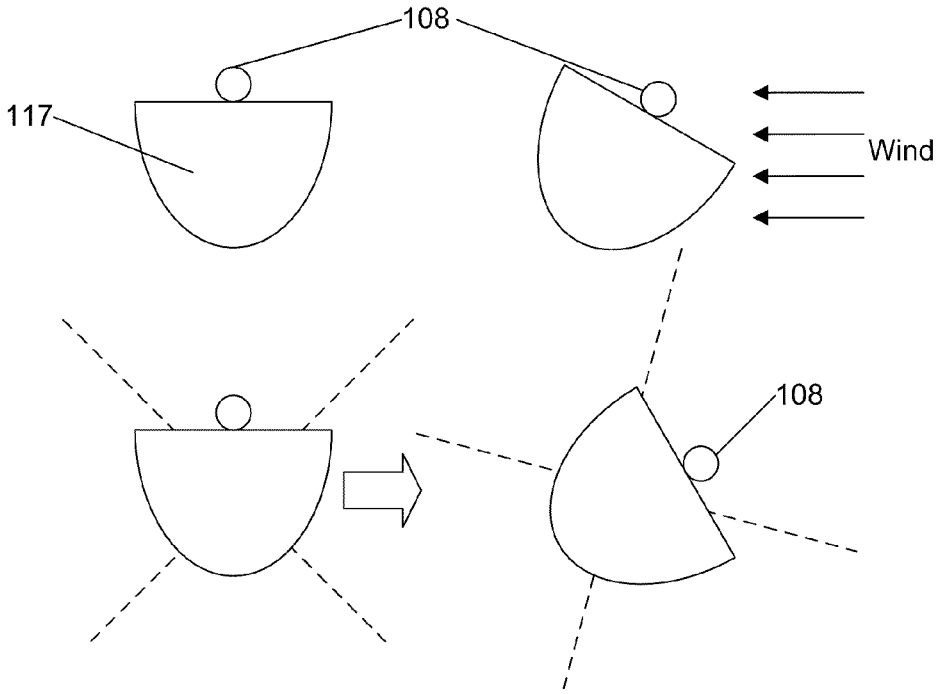
FIG. 2B is a schematic illustration of the antenna enclosure of FIG. 2A suspended from vertically from a strand in low or no wind conditions and the effect of wind on the enclosure.

FIG. 2B is a schematic illustration of the effect of wind on the enclosure 117, which is shown in cross section. On the upper left hand side, the antenna enclosure is hanging vertically downwards from messenger strand 108 under no wind or low wind conditions. As illustrated on the right hand side of FIG. 2B, when a certain wind speed perpendicular to the side wall of the enclosure is reached, the forces over and under the enclosure tend to balance out due to the curved, tapering outer side walls and curved, convex cover, reducing the risk of excessive tilting. The upper right hand drawing shows the enclosure tilting to the left as a result of wind impinging on the right hand side face of the enclosure, as indicated by the arrows. The lower left hand side shows the antenna enclosure in the same orientation as in the drawing above, and the 3 dB vertical beamwidth lines are shown in dotted outline. The same beamwidth lines are illustrated on the right hand side with the enclosure tilted to the left as a result of wind. As illustrated, if the tilting does not exceed the 3 dB point where power drops off, the performance of antenna enclosure 117 is not significantly disrupted by heavy wind loading. The enclosure is more aerodynamic and wind resistant than a rectangular box enclosure with flat side walls.

Figure 11:
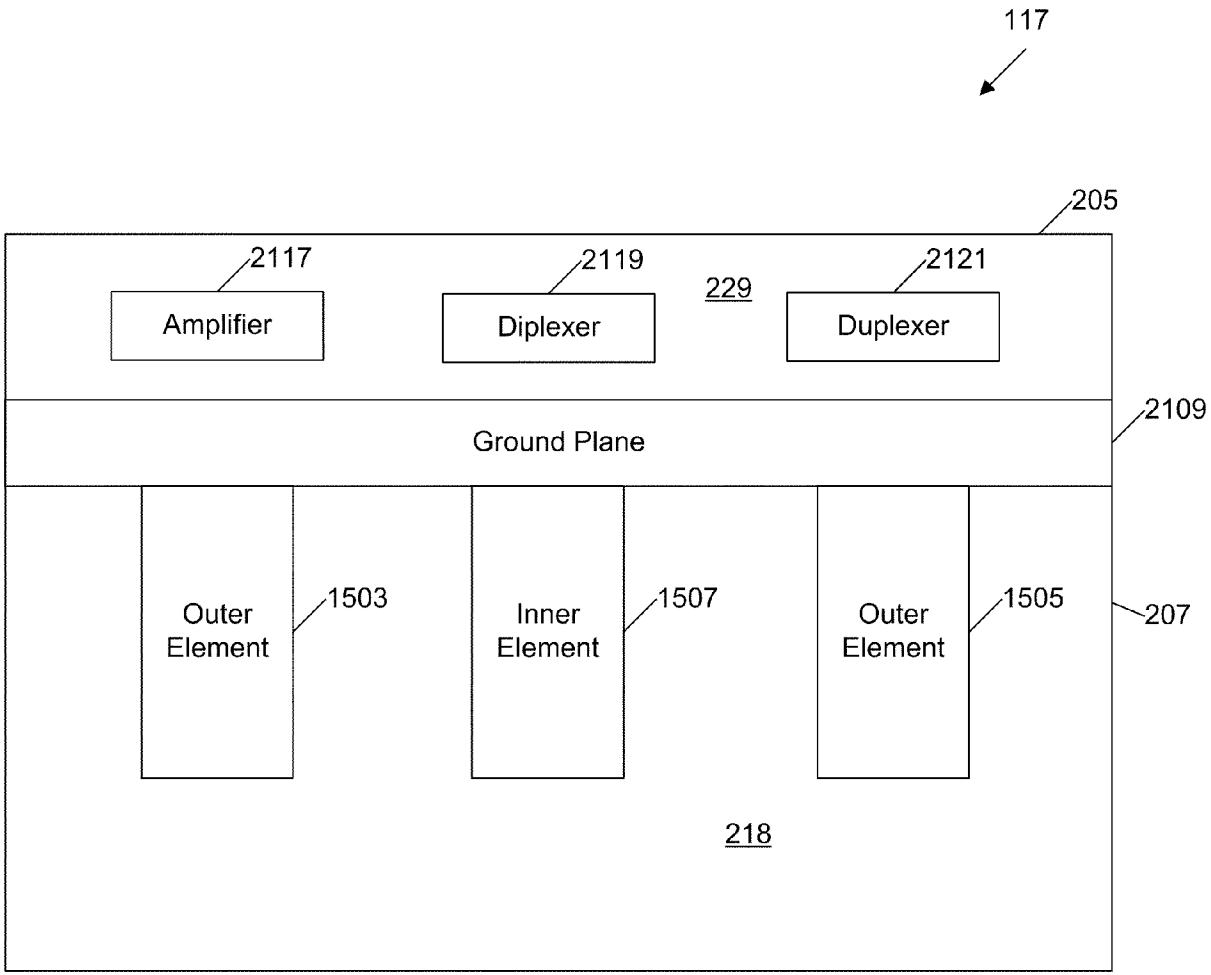
FIG. 11 is a schematic block diagram of the antenna enclosure showing location of system components in the enclosure according to an embodiment.

FIG. 10 is a cross section of one embodiment of an antenna enclosure 117 with a ground plane 2109 and antenna elements 1503, 1507 and 1505 mounted inside the enclosure, while FIG. 11 is a schematic block diagram of the antenna enclosure 117 and typical internal components according to an embodiment. The cover 205 is mechanically coupled to base 206 and to the ground plane 2109. The outer antenna elements 1503 and 1505 and the inner antenna element 1507 are mechanically coupled and electrically connected to the ground plane 2109. As illustrated in FIGS. 10 and 11, the concave inner face 236 of cover 205 provides space 229 in the enclosure above the ground plane 2109. In one embodiment, this space may be filled with additional circuitry such as an amplifier 2117, diplexer 2119, duplexer 2121, or other circuitry mounted on the upper surface of ground plane 2109. The additional circuitry may be connected to and draw power from the coaxial cables 224 used in the antenna enclosure 117. In one embodiment, circuitry from the base station enclosure 109 may be moved to the antenna enclosure by utilizing this extra space. Alternatively, the antenna enclosure is used exclusively for the antenna elements and associated circuitry. In this manner, the weight and heat dissipation can be balanced between the base station enclosure 109 and the antenna enclosure 117. Further, as the extra circuitry is located above the ground plane, there is little impact on the gain pattern generated by the antenna elements.

The ground plane 2109 may be mechanically coupled to the flat ends 223 of projections 213 inside the cover via suitable side mounting tabs projecting from opposite sides of the ground plane, while the antenna elements are secured to the lower face of ground plane or plate 2109 so that they extend downwardly into the interior of base 206 between ribs 220 when the cover is coupled to the base as seen in FIG. 10. As illustrated in FIG. 10, the mounting tabs at the periphery of the ground plane are located between the opposing flat ends 223 and 222 of projection 221 and ribs 220, respectively. The antenna elements are in electrical communication with suitable internal cable connectors or components on the upper surface of ground plane or plate 1509, which are connected to coaxial cables 224 connected to the respective external coaxial connectors 208 at one end of the cover.

In one example, antenna enclosure 117 is suspended from a wire or messenger strand, such as the wire 108 of FIG. 1, by the support members or connecting brackets 203. A corresponding base station enclosure 109 connects to the antenna enclosure 117 via the connectors 208 using a pair of coaxial cables. Circuitry inside the base station enclosure 109 is thereby able to send and receive signals via the outer antenna elements 1503 and 1505 in the antenna enclosure 117. The antenna elements and ground plane in one embodiment are configured for multi-directional patterns, but may be configured for omni-directional patterns in other embodiments, based on system requirements. In one embodiment, the outer antenna elements 1503 and 1505 are each wideband elements and are oppositely directed as illustrated in FIG. 10. For example, the outer antenna elements 1503 and 1505 may be configured to receive signals in the 690-960 MHz range as well as in the 1710-2170 MHz range. In one embodiment, the inner antenna element 1507 provides diversity for the outer antenna elements 1503 and 1505. Advantageously, the combination of the base station enclosure 109 and the antenna enclosure 117 may be used to provide coverage for wireless network operators using a wide range of frequencies. As shown, the antenna elements 1503, 1505 and 1507 may be directional antenna elements. Accordingly, as described in greater detail below, the antenna enclosure 117 of FIG. 15 may operate to generate a directional coverage area. It will be appreciated that other antenna configurations may be used to generate other coverage areas as described herein.

Figure 12:
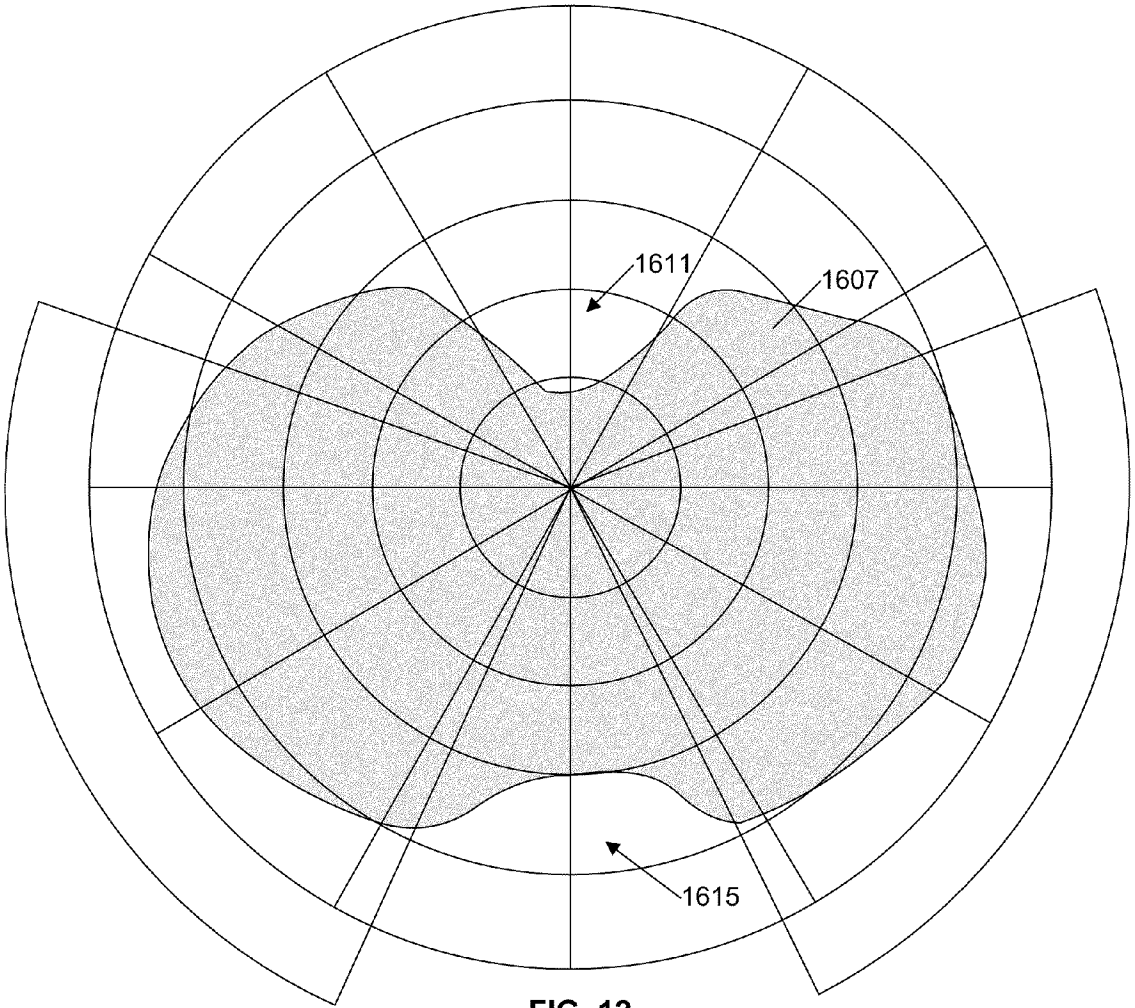
FIG. 12 is an illustration of a gain profile according to an embodiment.

FIG. 12 is an illustration of a vertical gain profile for the antenna enclosure 117 according to an embodiment. Advantageously, the antenna elements within the antenna enclosure 117 may be configured to generate one or more gain patterns. By controlling the gain pattern, the coverage area provided by the antenna enclosure 117 and base station enclosure 109 can be adjusted to correspond to the coverage hole of a wireless network provider or to provide supplemental coverage in a congested area. As illustrated, the gain profile illustrates gain strength regions 1607 with respect to direction. For reference, the support wire 108 may be visualized as running into and out of the profile. In one embodiment, the regions 1607 of the profile with the greatest gain range are from approximately 30 degrees above the horizon to approximately 60 degrees below the horizon. In another embodiment, the regions with the greatest gain range are from approximately 20 degrees above the horizon to approximately 65 degrees below the horizon. It will be appreciated that other configurations and orientations may be used as well. Advantageously, by having strong gain slightly above the horizon, coverage can be provided for geographies including hills or buildings that rise above the height of the antenna enclosure 117.

In one embodiment, the region directly above the antenna enclosure 1611 and the region directly below the antenna enclosure 1615 have relatively lower gains. In particular, in some embodiments, gain in the region 1611 may be largely wasted as few communication devices can be expected to be located directly above the antenna enclosure 117 hanging from the wire 108 supported by the utility poles 107. Advantageously, by shaping the gain regions 1607 to avoid areas that are unlikely to contain communication devices, additional energy can be directed in useful directions. The profile is omni-directional in that the regions 1607 with stronger gain extend outwards in a circular 360 degree fashion when viewed in the horizontal dimensions, from above or below the antenna enclosure 117. However, directional patterns or other types of patterns may be formed using alternate antenna elements such that the radiation pattern is directed in a desired direction where wireless coverage is needed.

Figure 13:
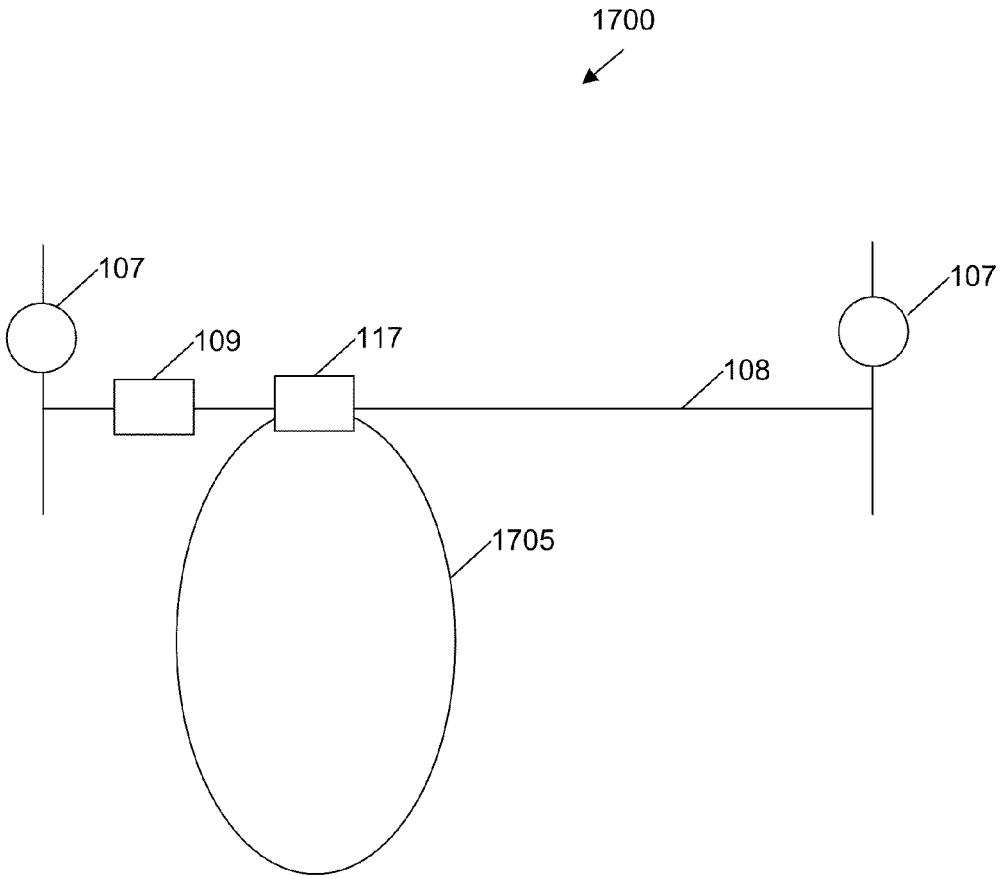
FIG. 13 is a block diagram of the system of FIG. 1 illustrating a gain profile.

FIG. 13 is a block diagram of system 1700 from below, illustrating a directional gain profile 1705 according to an embodiment which may use antenna elements as illustrated in FIG. 10. As shown in a top view, the system 1700 includes utility poles 107, wire or messenger strand 108, base station enclosure 109, and antenna enclosure 117. The wire 108 is connected to and extends between utility poles 107. The base station enclosure 109 and antenna enclosure 117 are mechanically coupled to and supported by the wire 108. The directional gain profile 1705 is directional in the sense that it is concentrated on one side of the antenna enclosure 117 instead of having a gain profile as described above with respect to the omni-directional gain profile of FIG. 12. The directional gain profile 1705 may have similar vertical properties with respect to the horizon as described above with respect to FIG. 12. Advantageously, by using a directional pattern, the coverage provided by the antenna enclosure 117 can be tailored to match the geometry of a coverage hole in a provider's network. For example, if a series of utility poles run along the edge of an area where additional coverage is desired, it may be preferable to use a directional gain pattern. However, where the series of utility poles runs through the center of such an area, an omni-directional pattern may be preferred.

Figure 14:
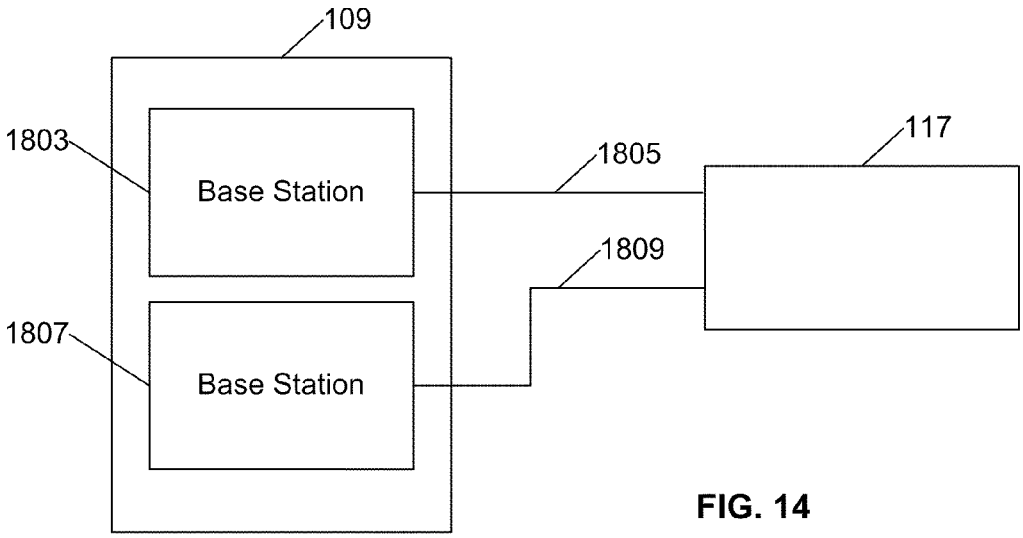
FIG. 14 is a block diagram illustrating the interaction of a base station enclosure and an antenna enclosure according to one embodiment.

FIG. 14 is a block diagram illustrating an interaction of a base station enclosure 109 and an antenna enclosure 117 according to an embodiment. The base station enclosure 109 comprises base station module 1803 corresponding to a first band and base station module 1807 corresponding to a second band. Each base station module 1803 and 1807 provides the functionality of a base station or wireless access point and uses the cable plant for backhaul as described in connection with FIG. 1. Each respective base station module 1803 and 1807 is connected via respective coaxial cables 1805 and 1809 to the antenna enclosure 117 and to respective radiating antenna elements inside the antenna enclosure 117. As described above, each radiating antenna element in the antenna enclosure 117 may be a wideband antenna element configured to receive signals over a wide range of frequencies. Further, each radiating antenna element may be driven separately by respective base station module 1803 and 1807 and coaxial cables 1805 and 1809. Thus, for example, the module 1803 can drive a first antenna element using a first band while the module 1807 can drive a second antenna element using a second band. Advantageously, because separate antenna elements are used by each base station module 1803 and 1807, no diplexer or similar circuitry is necessary. By omitting the diplexer, the power consumption, heat dissipation, and form factor of the base station enclosure 109 may be reduced. In one embodiment, the coverage areas provided by the first and second antenna elements in the antenna enclosure 117 largely overlap. Thus, modules 1803 and 1807 corresponding to different wireless network operators can provide coverage in the same area. However, in other embodiments, the coverage area provided by the first and second antenna elements may diverge significantly, allowing each wireless network operator to provide a different coverage area using the antenna enclosure. It will be appreciated by one of skill in the art that various combinations of antenna elements may be used to generate different coverage areas.

Figure 15:
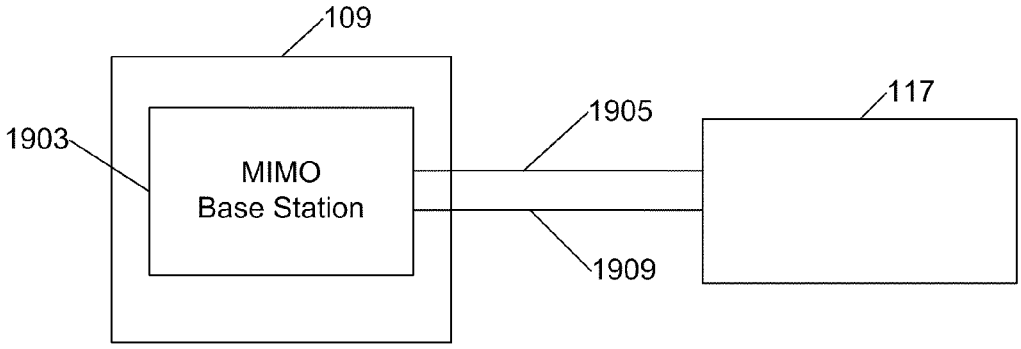
FIG. 15 is a block diagram illustrating an interaction of a base station enclosure and an antenna enclosure according to another embodiment.

FIG. 15 is another block diagram illustrating an interaction of a base station enclosure 109 and an antenna enclosure 117 according to an embodiment. The base station enclosure 109 comprises multiple input, multiple output (MIMO) base station module 1903. The MIMO module 1903 is connected to the antenna enclosure 117 via two coaxial cables 1905 and 1909. The MIMO module 1903 drives the radiating antenna elements in the antenna enclosure 117 in order to send and receive MIMO communications. In one embodiment, two radiating antenna elements are provided in the antenna enclosure and the MIMO module 1903 corresponds to a 2×2 MIMO system. However, in another embodiment, a second antenna enclosure (not shown) could be added to the system and the MIMO module 1903 could be configured to operate as a 4×4 MIMO system. One of ordinary skill in the art would appreciate that other combinations and arrangements are also possible.

Figure 16:
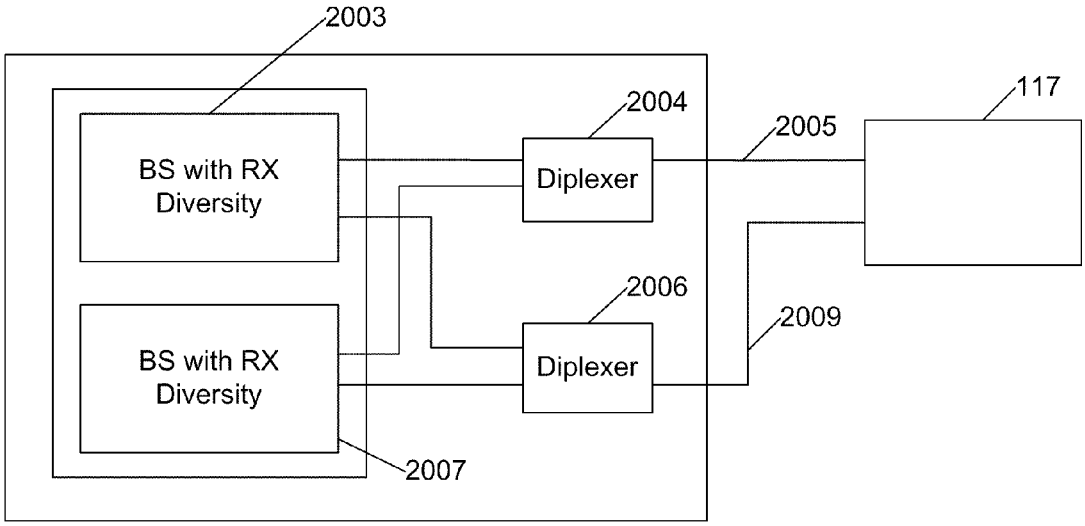
FIG. 16 is another block diagram illustrating an interaction of a base station enclosure and an antenna enclosure according to another embodiment.

FIG. 16 is another block diagram illustrating an interaction of a base station enclosure 109 and an antenna enclosure 117 according to an embodiment. In one embodiment, the base station enclosure 109 comprises base station module with receive diversity 2003 corresponding to a first band and base station module with receive diversity 2007 corresponding to a second band 2007. The base station enclosure further comprises first and second diplexers 2004 and 2006. Each base station module 2003 and 2007 is connected to both diplexers 2004 and 2006. The diplexers 2004 and 2006 are connected to the antenna enclosures 117 via the coaxial cables 2005 and 2009. As described above, the antenna enclosure may comprise two radiating, wideband antenna elements. The RF signals picked up by each radiating antenna element are separated by the diplexers 2004 and 2006 into respective first and second bands. The signals corresponding to the first band that are separated by each diplexer 2004 and 2006 are passed to the base station module 2003 corresponding to the first band. The signals corresponding to the second band that are separated by each diplexer are passed to the base station module 2007 corresponding to the second band. In this manner, each base station module 2003 and 2007 operating in distinct bands can be provided with receive diversity using a single antenna enclosure 117.

The antenna enclosure described above may incorporate antenna elements which utilize omni-directional and directional antenna patterns to optimize local wireless or cellular coverage areas and provide high gain within the form factor while maintaining good performance in all cellular bands. The antenna enclosure provides an efficient and easily installed strand mounted antenna solution for dual band, diversity, and MIMO applications. The enclosure may have inwardly tapering side walls forming a generally V-shaped cross-section so that it tends to hang vertically downwards in low or no wind conditions and is more aerodynamic than a rectangular box-shaped enclosure. The indented channels and resultant internal ribs in the side walls provide increased strength and wind resistance. The overall appearance is aesthetically more pleasing and blends in with other strand mounted equipment and cable components.

Those of skill will appreciate that the various illustrative logical blocks, modules, units, and algorithm steps described in connection with the embodiments disclosed herein can often be implemented as electronic hardware, computer software, or combinations of both. To clearly illustrate this interchangeability of hardware and software, various illustrative components, units, blocks, modules, and steps have been described above generally in terms of their functionality. Whether such functionality is implemented as hardware or software depends upon the particular system and design constraints imposed on the overall system. Skilled persons can implement the described functionality in varying ways for each particular system, but such implementation decisions should not be interpreted as causing a departure from the scope of the invention. In addition, the grouping of functions within a unit, module, block or step is for ease of description. Specific functions or steps can be moved from one unit, module or block without departing from the invention.

The various illustrative logical blocks, units, steps and modules described in connection with the embodiments disclosed herein can be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor can be a microprocessor, but in the alternative, the processor can be any processor, controller, microcontroller, or state machine. A processor can also be implemented as a combination of computing devices, for example, a combination of a DSP and a microprocessor, a plurality of microprocessors, one or more microprocessors in conjunction with a DSP core, or any other such configuration.

The steps of a method or algorithm and the processes of a block or module described in connection with the embodiments disclosed herein can be embodied directly in hardware, in a software module (or unit) executed by a processor, or in a combination of the two. A software module can reside in RAM memory, flash memory, ROM memory, EPROM memory, EEPROM memory, registers, hard disk, a removable disk, a CD-ROM, or any other form of machine or computer readable storage medium. An exemplary storage medium can be coupled to the processor such that the processor can read information from, and write information to, the storage medium. In the alternative, the storage medium can be integral to the processor. The processor and the storage medium can reside in an ASIC.

Various embodiments may also be implemented primarily in hardware using, for example, components such as application specific integrated circuits ("ASICs"), or field programmable gate arrays ("FPGAs"). Implementation of a hardware state machine capable of performing the functions described herein will also be apparent to those skilled in the relevant art. Various embodiments may also be implemented using a combination of both hardware and software.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

We claim:

1. An antenna enclosure, comprising:

a hollow shell of material which is transparent to at least a selected frequency range of radio frequency (RF) radiation, the shell having an upper end and a lower end;

at least a first antenna element mounted inside the shell;

at least one connecting bracket coupled to the upper end of the shell and configured for connecting the antenna enclosure to a line extending in a first direction between two utility poles such that the hollow shell is suspended from the line; and at least one cable connector extending through the shell and configured for connection to external and internal cables for signal communication to and from the antenna element.

2. The antenna enclosure of claim 1, wherein the shell is of generally tapering cross-sectional area towards the lower end of the shell.

3. The antenna enclosure of claim 1, wherein the shell has a shape which is elongated in the first direction and tapers inwardly in a vertical direction between the upper and lower end of the shell.

4. The antenna enclosure of claim 3, wherein first and second spaced connecting brackets are coupled to the upper end of the shell and configured for connecting the antenna enclosure to spaced locations on a line.

5. The antenna enclosure of claim 4, wherein the shell has an upper end wall, opposite side walls and opposite end walls, and the side walls are of inwardly tapering shape towards the lower end of the shell, the side walls defining a generally V-shaped vertical cross-section through the shell in a direction transverse to the first direction, and the lower end forming the apex of the V-shape.

6. The antenna enclosure of claim 5, wherein the side walls are of curved tapering shape and the apex is rounded.

7. The antenna enclosure of claim 6, wherein the opposite end walls are flat.

8. The antenna enclosure of claim 7, wherein the upper end wall is arched upwardly between the opposite side walls.

9. The antenna enclosure of claim 3, wherein multiple antenna elements are mounted inside the shell at spaced locations along the length of the shell.

10. The antenna enclosure of claim 3, wherein the shell comprises a base having an open upper end and a cover secured over the open upper end of the base.

11. The antenna enclosure of claim 10, further comprising a plurality of co-planar mounting formations inside the hollow shell, and a ground plane secured to the mounting formations and extending across at least part of the open upper end of the base, the first antenna element being mechanically coupled and electrically connected to the ground plane.

12. The antenna enclosure of claim 11, wherein the first antenna element is located inside the base, and the cover forms an upper end wall of the shell having a concave inner face configured to provide space inside the shell above the ground plane, and circuitry components associated with the antenna element are mounted on top of the ground plane.

13. The antenna enclosure of claim 10, wherein the base has opposite side walls which taper inwardly from the upper end to the lower end and form a generally V-shaped cross section in a second direction transverse to the first direction, and the cover is of upwardly arched shape between the side walls in the second direction.

14. The antenna enclosure of claim 13, wherein the base and cover have opposite, substantially flat end walls, and each end wall of the base is substantially co-planar with the corresponding end wall of the cover.

15. The antenna enclosure of claim 14, wherein the cable connector is located in one of the end walls of the cover.

16. The antenna enclosure of claim 13, wherein two coaxial cable connectors extend through an end of the shell.

17. The antenna enclosure of claim 16, wherein a plurality of antenna elements are mounted in the housing, and each antenna element communicates with at least one of the cable connectors.

18. The antenna enclosure of claim 13, further comprising a plurality of vertically extending ribs on each side wall inside the base.

19. The antenna enclosure of claim 13, further comprising a plurality of outwardly facing, vertically extending grooves of tapering depth in each side wall extending from the upper end opening towards the lower end.

20. The antenna enclosure of claim 13, wherein the cover has a pair of spaced mounting recesses and first and second spaced connecting brackets each have a first end seated in a respective mounting recess and coupled to the cover, and a second end configured for connection to a line.

21. The antenna enclosure of claim 1, further comprising at least one additional antenna element mounted inside the shell.

22. A wireless communication access system, comprising:

at least one base station mechanically supported by a line extending in a first direction between two utility poles;

at least one antenna enclosure mechanically supported by the line at a location spaced from the base station, and at least one antenna element mounted inside the enclosure; and a communication cable extending between the base station and antenna enclosure and configured for radio frequency (RF) signal communication between the antenna element and base station.

23. The system of claim 22, wherein the line is a messenger strand.

24. The system of claim 22, wherein the antenna enclosure has an upper end and a lower end, and has a shape which is elongated in the first direction and tapers inwardly in a vertical direction between the upper and lower ends of the enclosure.

25. The system of claim 24, further comprising first and second spaced connecting brackets coupled to the upper end of the enclosure and coupled to spaced locations on the line to suspend the enclosure below the line.

26. The system of claim 24, wherein the shell has an upper end wall, opposite side walls and opposite end walls, and the side walls are of inwardly tapering shape towards the lower end of the shell, the side walls defining a generally V-shaped vertical cross-section through the shell in a direction transverse to the first direction, and the lower end forming the apex of the V-shape.

27. The system of claim 24, wherein the antenna enclosure comprises a base having an open upper end and a cover secured over the open upper end of the base.

28. The system of claim 24, wherein an antenna assembly having one or more antenna elements is mounted inside the enclosure and is configured to create a gain profile which has regions of stronger gain extending outwards from each side of the enclosure.

29. The system of claim 22, wherein at least two antenna elements are mounted inside the enclosure.

* * * * *